US012179061B2

(12) United States Patent
Zimmer

(10) Patent No.: US 12,179,061 B2
(45) Date of Patent: Dec. 31, 2024

(54) SENSOR ENABLED EXERCISE SLIDER

(71) Applicant: Trent Zimmer, Broussard, LA (US)

(72) Inventor: Trent Zimmer, Broussard, LA (US)

( * ) Notice: Subject to any disclaimer, the term of this patent is extended or adjusted under 35 U.S.C. 154(b) by 414 days.

(21) Appl. No.: 17/722,293

(22) Filed: Apr. 15, 2022

(65) Prior Publication Data

US 2022/0331661 A1 Oct. 20, 2022

Related U.S. Application Data

(60) Provisional application No. 63/176,194, filed on Apr. 16, 2021.

(51) Int. Cl.
*A63B 24/00* (2006.01)

(52) U.S. Cl.
CPC ..... *A63B 24/0062* (2013.01); *A63B 2220/53* (2013.01); *A63B 2220/801* (2013.01); *A63B 2220/805* (2013.01); *A63B 2220/833* (2013.01)

(58) Field of Classification Search
CPC ..... A63B 24/0062; A63B 2220/53; A63B 2071/0655; A63B 2220/13; A63B 2220/51; A63B 2225/20; A63B 22/20; A63B 2225/50
See application file for complete search history.

(56) References Cited

U.S. PATENT DOCUMENTS

| | | | | |
|---|---|---|---|---|
| 6,942,605 | B1 | 9/2005 | Sukhovitsky | |
| 7,553,267 | B1 | 6/2009 | Hauser et al. | |
| D654,545 | S | 2/2012 | Richard | |
| 8,382,645 | B2 | 2/2013 | Mylrea et al. | |
| 8,702,574 | B2 | 4/2014 | Abranchess | |
| 10,933,278 | B2 | 3/2021 | Moridaira | |
| 2006/0040809 | A1 | 2/2006 | Godbold | |
| 2015/0343263 | A1 * | 12/2015 | Sampath | A63B 21/012 482/8 |

FOREIGN PATENT DOCUMENTS

| | | | | |
|---|---|---|---|---|
| GB | 2503701 A * | 1/2014 | | A61H 1/0237 |
| WO | WO-2019122885 A1 * | 6/2019 | | A61B 5/1125 |
| WO | WO-2021181071 A1 * | 9/2021 | | A61H 1/0237 |

* cited by examiner

*Primary Examiner* — Francis C Gray
(74) *Attorney, Agent, or Firm* — Asgaard Patent Services, LLC; F. Wayne Thompson, Jr.

(57) ABSTRACT

Disclosed are implementations of a sensor enabled exercise slider configured to detect movement and applied force. A sensor enabled exercise slider is a limb-actuated, linearly and circularly moveable, apparatus configured to facilitate a variety of exercises. An example limb-actuated exercise slider comprises: a housing that is smoothly slidable across a contacted surface in contact with an undersurface of the housing; and an electronic circuit carried by the housing. The electronic circuit is configured to detect movement of the housing and to detect force applied to a top surface of the housing. In some implementations, the undersurface in contact with the contacted surface has a friction coefficient permitting the sliding.

9 Claims, 6 Drawing Sheets

SENSOR ENABLED EXERCISE SLIDER

CROSS REFERENCE TO RELATED APPLICATION

This application claims the benefit of U.S. Provisional Application Ser. No. 63/176,194, filed on Apr. 16, 2021, the entirety of which is incorporated herein by reference.

TECHNICAL FIELD

This disclosure relates to implementations of a sensor enabled exercise slider.

BACKGROUND

There exists a need for a portable exercise device that allows a user to tone and strengthen muscles of the arms, shoulders, back, abdomen, legs, or a combination thereof depending on the exercise being performed.

Data collection is a routine part of strength and conditioning training. This quantitative data can be used to track the effectiveness of an exercise routine, and guide the selection of exercises performed as part of the exercise routine. However, without the aid of a monitoring device, tracking user progress, such as movement, duration, and weight distribution, during an exercise routine, and the selection of exercises that will achieve a desired outcome, can be problematic.

Accordingly, it can be seen that needs exist for the sensor enabled exercise slider disclosed herein. It is to the provision of a sensor enabled exercise slider configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed are implementations of a sensor enabled exercise slider configured to detect movement and applied force. The sensor enabled exercise slider is a limb-actuated, linearly and circularly moveable, apparatus configured to facilitate a variety of exercises. In particular, the sensor enabled exercise slider can be used to tone and strengthen muscles of the arms, shoulders, back, abdomen, legs, or a combination thereof depending on the exercise being performed. In general, either two or four exercise sliders would be used to perform an exercise.

An example sensor enabled exercise slider comprises: a housing that is smoothly slidable across a contacted surface in contact with an undersurface of the housing; and an electronic circuit carried by the housing. The electronic circuit includes an optical sensor configured to detect movement of the housing, and at least one compression force sensor configured to detect force applied to a top surface of the housing.

Another example sensor enabled exercise slider comprises: a housing that is smoothly slidable across a contacted surface in contact with an undersurface of the housing; and an electronic circuit carried by the housing. The undersurface in contact with the contacted surface has a friction coefficient permitting the sliding. The electronic circuit includes an optical sensor configured to detect movement of the housing, and four compression force sensors configured to detect force applied to a top surface of the housing.

Yet another example sensor enabled exercise slider comprises: a housing that is smoothly rotatable on, and smoothly slidable across, a contacted surface in contact with an undersurface of the housing; and an electronic circuit carried by the housing. The undersurface of the housing in contact with the contacted surface has a friction coefficient permitting the rotation and sliding. The electronic circuit includes an optical sensor configured to detect movement of the housing, and at least one compression force sensor configured to detect force applied to a top surface of the housing.

BRIEF DESCRIPTION OF THE DRAWINGS

Like reference numerals refer to corresponding parts throughout the several views of the drawings.

DETAILED DESCRIPTION

Figure 1:
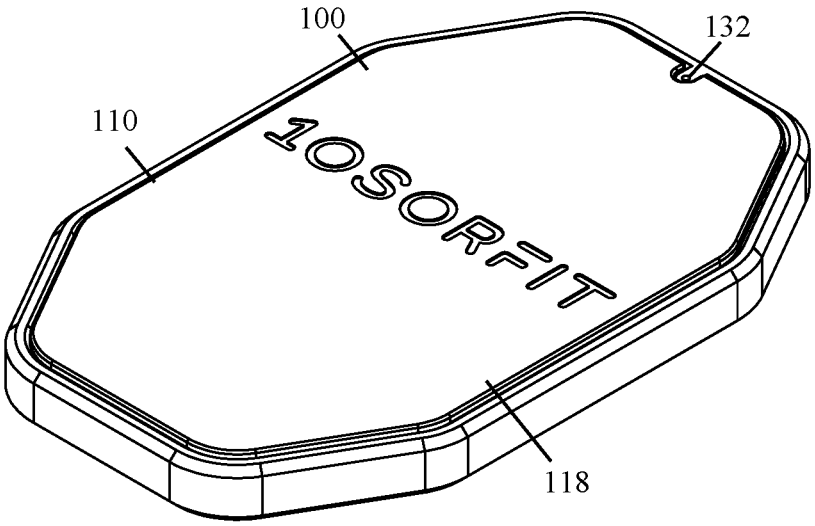
FIG. 1 illustrates an isometric view of an exemplary implementation of a sensor enabled exercise slider according to the principles of the present disclosure.

FIGS. 1-5 illustrate an example sensor enabled exercise slider 100 according to the principles of the present disclosure. The sensor enabled exercise slider 100 is a limb-actuated, linearly and circularly moveable, apparatus configured to facilitate a variety of exercises. In particular, the sensor enabled exercise slider 100 can be used to tone and strengthen muscles of the arms, shoulders, back, abdomen, legs, or a combination thereof depending on the exercise being performed. In general, either two or four exercise sliders 100 would be used to perform an exercise.

As shown in FIGS. 1-6, an example sensor enabled exercise slider 100 comprises a housing 110 containing an electronic circuit 112 configured to detect force applied to, and movement of, the exercise slider 100. The housing 110 includes a top member 114 secured to a base member 116. The top member 114 of the housing 110 is configured to allow a user to engage and drive the exercise slider 100, with the base member 116 against a surface, in an arbitrary direction for exercise.

Figure 2:
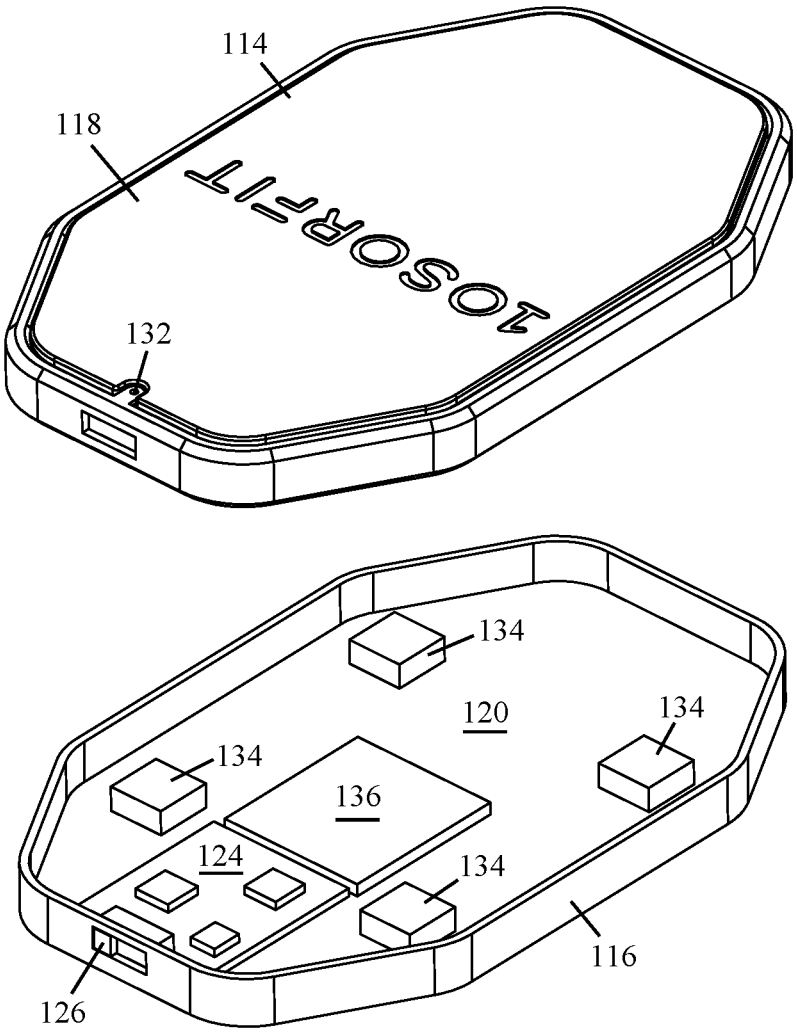
FIG. 2 illustrates an exploded view of the sensor enabled exercise slider shown in FIG. 1.
Figure 3:
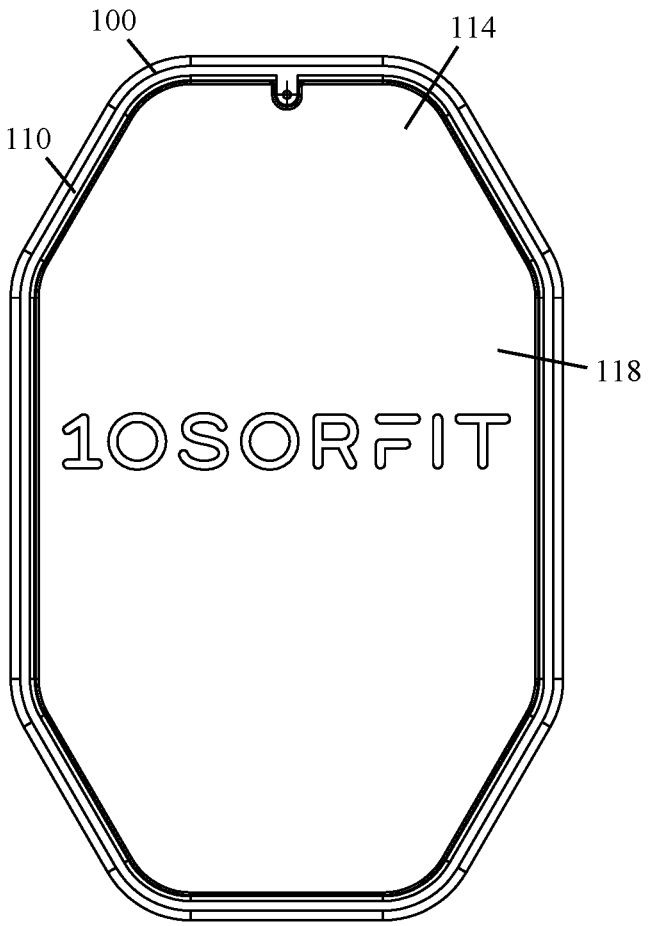
FIG. 3 illustrates a top plan view of the sensor enabled exercise slider shown in FIG. 1.
Figure 4:
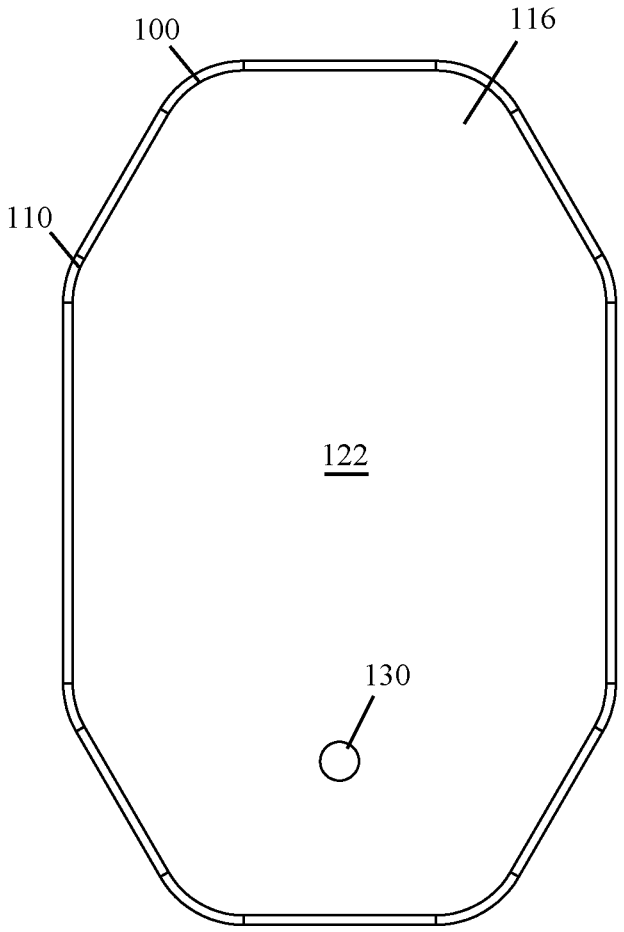
FIG. 4 illustrates a bottom plan view of the sensor enabled exercise slider shown in FIG. 1.
Figure 5:
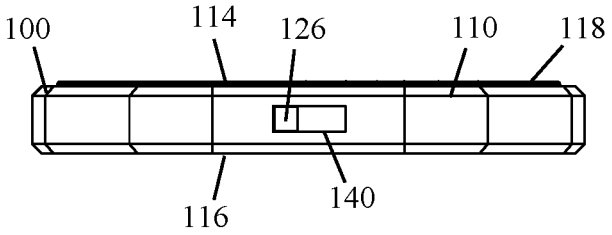
FIG. 5 illustrates a side elevational view of the sensor enabled exercise slider shown in FIG. 1.

As shown best in FIG. 2, the top and bottom members 114, 116 of the housing 110 define an interior compartment 120 that contains the various components of the electronic circuit 112. The top member 114 is shaped so that a limb of the body can rest thereon, for example, the palm of a hand, the bottom of a foot, or the toes or knee of a leg. In some implementations, the top member 114 is made of a resilient material (e.g., a thermoplastic) that recovers to its original state when weight it removed therefrom. The undersurface 122 of the bottom member 116 provides a sliding surface adapted to slide on an exercise floor. For the purposes of this disclosure, an "exercise floor" includes a floor, mat, or any other floor-like surface on which an exercise can be performed. Preferably, the undersurface 122 of the bottom member 116 has an appropriate friction coefficient for the skill level of the user. Thus, it should be understood that the invention could be sold in a variety of configurations having different coefficients of friction.

Alternatively, in some implementations, the bottom member 116 of the housing 110 may include caster wheels used to roll the exercise slider 100 in any direction (not shown).

As shown best in FIGS. 1 and 2, the exercise slider 100 includes a slip resistant mat 118 on the top member 114 of the housing 110. In some implementations, instead of a slip resistant mat 118, a slip resistant pattern is engraved on the top member 114 of the housing 110.

The electronic circuit 112 is configured to detect force exerted on the exercise slider 100. The electronic circuit 112 is also configured to detect movement of the exercise slider 100, for example, linear and rotational movements.

Figure 6:
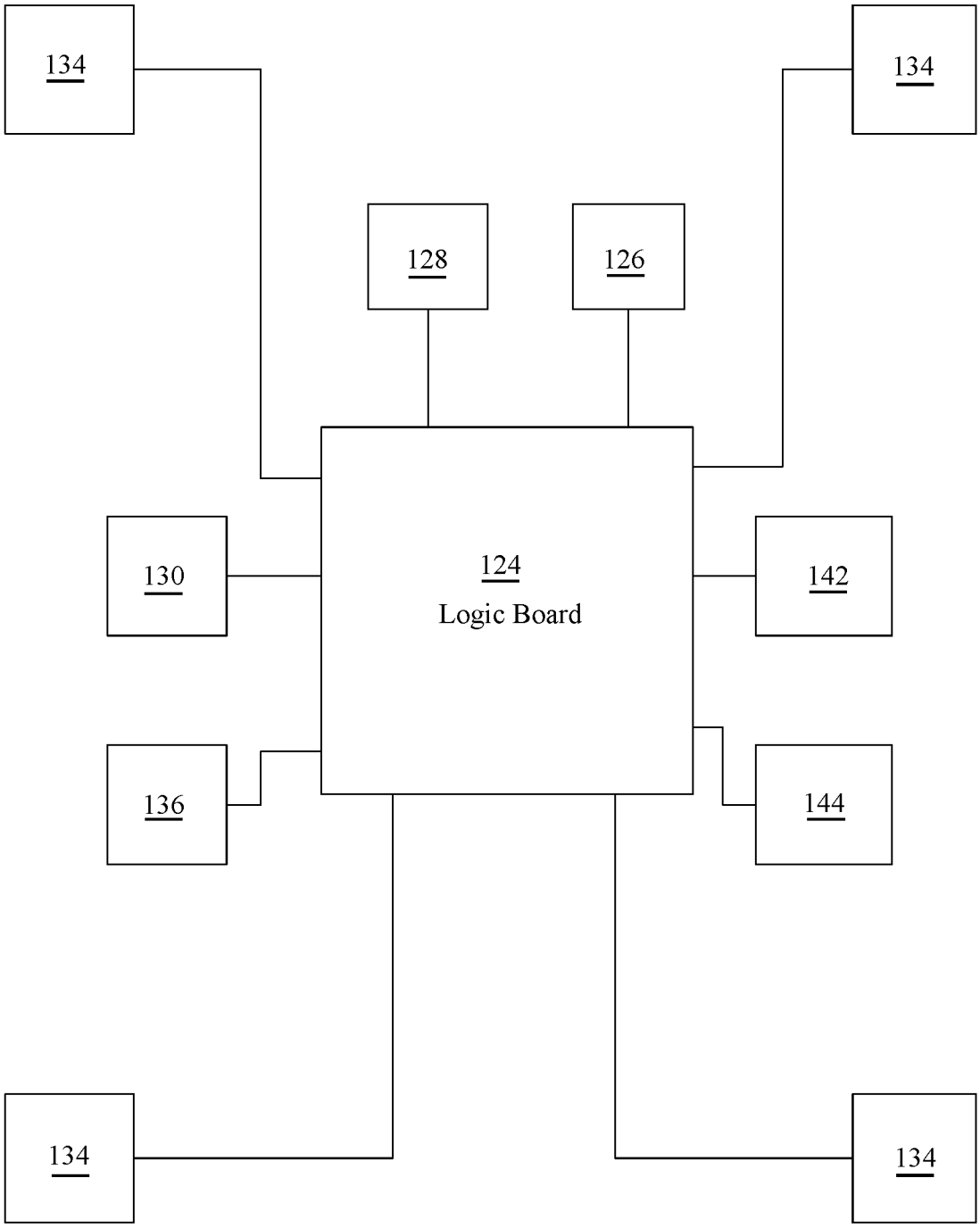
FIG. 6 illustrates an example electronic circuit for the sensor enabled exercise slider shown in FIG. 1.

As shown in FIGS. 2 and 6, an example electronic circuit 112 comprises a microprocessor and a nonvolatile memory mounted on a printed circuit board (PCB) 124, I/O (input/output) devices (e.g., an ON/OFF switch 126, a LED indicator light 128, an optical sensor 130, and four compression force sensors 134), and a system battery 136. While the example electronic circuit 112 includes four compression force sensors 134, other implementations of the electronic circuit 112 may only include one, two, or three compression force sensors 134. The exact number of compression force sensors 134 being, at least in part, a function of the specific type and model of force sensor selected.

The microprocessor of the electronic circuit 112 is configured to enable the exercise slider 100 to perform the functions that are implied and/or specified herein. In some implementations, the nonvolatile memory may be an integral part of the microprocessor, or a discrete component.

One or more I/O controllers are provided as needed to interface each I/O device (e.g., the ON/OFF switch 126, LED indicator light 128, optical sensor (130), and compression force sensors 134) with one or more other components of the electronic circuit 112 (e.g., the microprocessor).

The ON/OFF switch 126 of the electronic circuit 112 can be used to turn the exercise slider 100 ON and OFF. The ON/OFF switch 126 is accessible through in opening 140 in the housing 110. The electronic circuit 112 is configured so that toggling the switch 126 to the ON position causes the connected LED indicator light 128 to illuminate.

The light emitting diode (LEDs) of the indicator light 128 is visible through an opening 132 in the face of the top member 116 of the housing 110. The indicator light 128 provides visual feedback to the wearer regarding the status of the exercise slider 100 (i.e., when the indicator light 128 is illuminated the exercise slider 100 is ON).

The optical sensor 130 included as part of the example electronic circuit 112 is a CMOS type electronic image sensor, well known to those of ordinary skill in the art. The optical sensor 130 is used to track movement (e.g., linear and rotational movements) of the exercise slider 100 during use. The optical sensor 130 is exposed to a contact surface underneath the exercise slider 100 by an opening in the undersurface 122 of the housing 110 (see, e.g., FIG. 4). In other implementations, the exercise slider 100 may include two or more optical sensors.

Each compression force sensor 134 is configured to measure a pushing force along a single axis. An example compression force sensor 134 may be a compression load cell or a beam load cell, well known to those of ordinary skill in the art. However, it should be understood that any force sensor (e.g., an FSR) having a suitable form factor that is capable of measuring a pushing force could be used.

As shown best in FIG. 2, the compression force sensors 134 of the electronic circuit 112 are positioned underneath the top member 114 of the housing 110. In this way, while a limb of the user is resting on the exercise slider 100, downward force exerted by the limb on the top member 114 can be measured by the underlying compression force sensors 134. The compression force sensors 134 may also be used to detect an absence of force (e.g., when the limb is removed from contact with the top member 114 of the exercise slider 100). Please note that, in some implementations, while a downward force is being applied to the top member 114, at least a portion of the top member 114 is configured to resiliently deform and make contact with underlying compression force sensors 134.

The system battery 136 may be a rechargeable pouch cell, or another electrochemical cell having a suitable form factor.

As shown in FIG. 6, the electronic circuit 112 of an exercise slider 100 may include a wireless transceiver 142, and at least one suitable communication protocol stored in nonvolatile memory (e.g., short-link radio technology such as Bluetooth). In this way, the exercise slider 100 can interface with mobile devices such as smartphones, tablet computers, etc. More specifically, the wireless transceiver 142 of an exercise slider 100 can be used to communicate relative position, rotation, and pressure detected (i.e., measured) by the optical sensor 130 and/or the compression force sensor(s) 134 to a mobile device having a compatible mobile application installed thereon.

A mobile device, having a suitably configured mobile application installed thereon, could be used to display exercise training programs for the user. Such a mobile application could be configured to correlate relative position, rotation, and pressure detected (i.e., measured) by the optical sensor 130 and/or the compression force sensor(s) 134 of each connected exercise slider 100 to an exercise training program being shown to the user. In this way, the user's progress through an exercise program could be tracked. Exercise programs can be provided separately, with an option to download a desired exercise program on a mobile device with a suitably configured mobile application installed thereon.

As shown in FIG. 6, in some implementations, the electronic circuit 112 of the exercise slider 100 may include a haptic feedback device 144 configured to provide haptic feedback (i.e., vibration). Specifically, in such an implementation, the haptic feedback device 144 would be positioned to produce vibration felt by the limb of the body resting on the top member 114 of the housing 110. As nonlimiting examples, haptic feedback may be generated to indicate the beginning and/or end of an exercise routine, when the user exerts force on the exercise slider 100 greater than or equal to a specific value, and when the user fails to exert a force that is at least equal to a specific value.

Although not shown in the drawings, it will be understood that suitable wiring and/or traces connects the electrical components of the exercise slider 100 disclosed herein.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A limb-actuated exercise slider configured to detect movement and applied force, the limb-actuated exercise slider comprising:

a housing that is smoothly slidable across a contacted surface in contact with an undersurface of the housing; and an electronic circuit carried by the housing;

wherein:

the electronic circuit includes an optical sensor configured to detect movement of the housing; and the electronic circuit includes at least one compression force sensor configured to detect force applied to a top surface of the housing.

2. The limb-actuated exercise slider of claim 1, wherein the optical sensor is exposed to the contacted surface through an opening in the undersurface of the housing, and the at least one compression force sensor is positioned underneath the top surface of the housing.

3. The limb-actuated exercise slider of claim 2, wherein, while a downward force is being applied to the top surface of the housing, the top surface is configured to resiliently deform and make contact with the at least one compression force sensor.

4. A limb-actuated exercise slider configured to detect movement and applied force, the limb-actuated exercise slider comprising:

a housing that is smoothly slidable across a contacted surface in contact with an undersurface of the housing, the undersurface in contact with the contacted surface has a friction coefficient permitting the sliding; and an electronic circuit carried by the housing;

wherein:

the electronic circuit includes an optical sensor configured to detect movement of the housing; and the electronic circuit includes four compression force sensors configured to detect force applied to a top surface of the housing.

5. The limb-actuated exercise slider of claim 4, wherein the optical sensor is exposed to the contacted surface through an opening in the undersurface of the housing, and the four compression force sensors are positioned underneath the top surface of the housing.

6. The limb-actuated exercise slider of claim 5, wherein, while a downward force is being applied to the top surface of the housing, the top surface is configured to resiliently deform and make contact with underlying compression force sensors.

7. A limb-actuated exercise slider configured to detect movement and applied force, the limb-actuated exercise slider comprising:

a housing that is smoothly rotatable on, and smoothly slidable across, a contacted surface in contact with an undersurface of the housing, the undersurface in contact with the contacted surface has a friction coefficient permitting the rotation and sliding; and an electronic circuit carried by the housing;

wherein:

the electronic circuit includes an optical sensor configured to detect movement of the housing; and the electronic circuit includes at least one compression force sensor configured to detect force applied to a top surface of the housing.

8. The limb-actuated exercise slider of claim 7, wherein the optical sensor is exposed to the contacted surface through an opening in the undersurface of the housing, and the at least one compression force sensor is positioned underneath the top surface of the housing.

9. The limb-actuated exercise slider of claim 8, wherein, while a downward force is being applied to the top surface of the housing, the top surface is configured to resiliently deform and make contact with the at least one compression force sensor.

* * * * *